US007798428B1

(12) United States Patent
Weil

(10) Patent No.: US 7,798,428 B1
(45) Date of Patent: Sep. 21, 2010

(54) HIGH PRESSURE SPRAY CLEANING HEAD AND DISTRIBUTOR BODY

(75) Inventor: Randolph A. Weil, Highlands Ranch, CO (US)

(73) Assignee: K-O-K, LLC, Denver, CO (US)

( * ) Notice: Subject to any disclaimer, the term of this patent is extended or adjusted under 35 U.S.C. 154(b) by 852 days.

(21) Appl. No.: 11/646,880

(22) Filed: Dec. 28, 2006

(51) Int. Cl.

| | |
|---|---|
| ***F23D 11/16*** | (2006.01) |
| *F23D 11/10* | (2006.01) |
| *B05B 7/04* | (2006.01) |
| *B05B 7/30* | (2006.01) |
| *B05B 1/26* | (2006.01) |
| *B05B 9/00* | (2006.01) |

(52) U.S. Cl. ..... 239/420; 239/434; 239/318; 239/418; 239/511; 239/127; 239/510

(58) Field of Classification Search ..... 239/418, 239/420, 434, 318, 511, 510, 127, 222.17, 239/233, 230, 232, 422, 427, 543, 8, 424.5, 239/425, 427.3, 427.5, 428, 429, 430, 433, 239/455, 545

See application file for complete search history.

(56) References Cited

U.S. PATENT DOCUMENTS

| | | | | | |
|---|---|---|---|---|---|
| 1,108,058 | A * | 8/1914 | Yerkes | ..... | 239/275 |
| 1,828,183 | A * | 10/1931 | Grant | ..... | 239/420 |
| 3,050,261 | A * | 8/1962 | Littlefield | ..... | 239/318 |
| 3,844,485 | A * | 10/1974 | Waggoner, Robert A. | ... | 239/420 |
| 3,997,114 | A * | 12/1976 | Hewett | ..... | 239/127 |
| 4,046,321 | A * | 9/1977 | Hewett | ..... | 239/420 |
| 4,534,511 | A * | 8/1985 | Sullivan | ..... | 239/336 |
| 5,511,728 | A * | 4/1996 | Bailey | ..... | 239/423 |
| 5,749,523 | A * | 5/1998 | Drechsel | ..... | 239/233 |
| 6,280,072 | B1 * | 8/2001 | Poston | ..... | 366/1 |
| 6,301,849 | B1 * | 10/2001 | Roth | ..... | 52/302.6 |
| 2004/0112987 | A1 * | 6/2004 | Baker | ..... | 239/525 |

FOREIGN PATENT DOCUMENTS

| | | |
|---|---|---|
| CA | 1085112 | 9/1980 |

* cited by examiner

*Primary Examiner*—Len Tran
*Assistant Examiner*—Steven M Cernoch
(74) *Attorney, Agent, or Firm*—James Creighton Wray; Meera P. Narasimhan

(57) ABSTRACT

A spray head with improved distributor body for a high pressure spray cleaning apparatus is provided. The spray head is carried on the end of a hand held wand with control valves to separately regulate flow through a pair of fluid circuits, the spray head having a nozzle that sprays heated water in a fan-like pattern against a deflecting edge of a distributor body. Cleaning chemicals are forced through an aperture into the fan-like pattern prior to its striking the deflecting edge to be intimately mixed with the heated water to produce a mixture that strikes the deflecting edge and is deflected therefrom in a highly concentrated form at a high velocity. An elbow guard provides improved protection for the chemical cleaning fluid flow line where it connects to the spray head. Also disclosed is a spray head that allows for the separate application of fluids delivered from separate supply sources.

20 Claims, 4 Drawing Sheets

HIGH PRESSURE SPRAY CLEANING HEAD AND DISTRIBUTOR BODY

FIELD OF THE INVENTION

This invention generally relates to the mixing and spraying chemical cleaning fluids and more particularly to a novel and improved spray head and distributor body for pressurized spraying of chemicals that is particularly suitable for brick cleaning applications and the like.

BACKGROUND OF THE INVENTION

After the construction of brick structures, it is frequently necessary to remove undesirable materials from the surface thereof including splatters of paint, efflorescence, tar and portland cement and the like as a final cleaning operation. Manual cleaning with brushes or the like requires considerable time and effort. Some attempt has heretofore been made to provide pressurized spray cleaning apparatus for this purpose. One such pressurized spray cleaning apparatus is disclosed in U.S. Pat. No. 4,046,321, titled HIGH PRESSURE SPRAY CLEANING HEAD, which is hereby incorporated by reference in its entirety. However, difficulties have been encountered with the spray head of such apparatus with regard to the spray diffusion pattern, fluid flow, miss-alignment, fatigue and breaking.

Needs exist for an improved and novel spray head and distribution body that intimately mixes fluids delivered from separate supply sources.

Needs exist for an improved and novel spray head having a distributor body that provides a better spray diffusion pattern, is better constructed to resist breaking, is designed for improved, secure mounting on the spray head, and is shaped and configured for more economical production.

Needs also exit for an improved and novel spray head elbow guard that provides improved protection for the chemical cleaning fluid flow line where it connects to the spray head.

Further needs exist for an improved and novel spray head for restoration cleaning that allows for the separate application of fluids delivered from separate supply sources.

SUMMARY OF THE INVENTION

In accordance with the present invention, there is provided a spray head operated by a fluid under pressure for spray cleaning a surface. The spray head includes a distributor body of a cleaning chemical corrosion-resistant material having a top surface that is slightly inwardly concave in shape and a front surface that is substantially normal to the top surface. The front surface and top surface meet at a deflecting edge. The distributor body has a substantially trapezoidal configuration in horizontal cross-section. The distributor body has one, or two, discharge apertures in the top surface leading from one, or two, bores in the distributor body through which a jet, or jets, of a cleaning chemical fluid is delivered under pressure. The bore, or bores, are arranged at a forwardly directed angle to direct the jets of cleaning chemical fluid away from the top surface and toward the deflecting edge. The distributor body is made of a corrosion resistant material, for example zirconium, chlorinated polyvinyl chloride, or titanium. A spray nozzle support body is provided adjacent the distributor body having an inlet adapted to receive a supply of heated carrier fluid under pressure. The spray nozzle support body has a nozzle with an office located at the rear of and above the top surface of the distributor body and the discharge aperture, which produces a substantially horizontal, generally planar, fan-like pattern of heated carrier fluid and directs the spray pattern at a slight angle to the top surface toward and against the deflecting edge. In this way the jet of chemical cleaning fluid is emitted into the spray of heated carrier fluid prior to striking the deflecting edge and the cleaning chemical fluid and heated carrier fluid are intimately mixed. The mixture is deflected from the edge as a mixed spray in a concentrated form that is directed toward a surface to be cleaned.

The spray nozzle support body includes a throughbore having one end forming an inlet, and the spray nozzle with an orifice is mounted on the outlet end of the throughbore. The support body has a forked projecting portion connected to an elongated lug projecting portion on the distributor body.

The elongated lug portion of the distributor body is connected to the distributor body through a transition region having a radiused top and sides. The elongated lug portion includes a pair of horizontal apertures, and the support body projecting portion is a forked member that slidably receives the elongated lug portion. Two sets of opposed apertures in the forked member are aligned with the pair of apertures in the elongate lug portion. A pair of securing members extend through the aligned apertures and secure the distributor body to the support body.

Also provided is a U-shaped, stainless steel elbow guard. A pair holes in the arms of the U-shaped elbow guard are aligned with a third horizontal aperture in the distributor body. An elongated fastening member extends through the aligned apertures, securing the U-shaped elbow guard to the distributor body. The elbow guard provides improved protection for a chemical cleaning fluid flow line where it connects to the distributor body.

Further provided is a spray head that is particularly suited for restoration cleaning of a surface by spraying, whereby after covering an area with chemical cleaning fluid an operator rinses the area with pressurized water. The restoration cleaning spray head has a chlorinated polyvinyl chloride (CPVC) distributor body of generally trapezoidal, oblong shape. The distributor body has a top surface, a bottom surface, opposed side wall surfaces and a front wall surface. The top wall surface is slightly inwardly concave and the top and front wall surfaces meet at a leading deflecting edge. At least one discharge aperture is present in the top surface and leads from at least one bore in the distributor body arranged at a forwardly directed angle. The distributor body has a lug portion projecting away from a rear wall surface with a pair of apertures. A support body has a forked projecting portion extending forwardly of a front wall surface. The forked projecting portion slidably receives the lug portion and has two sets of opposed apertures aligned with the apertures in the lug portion. A pair of securing members extending through the aligned apertures secure the distributor body to the support body. The support body has a throughbore passing through the front wall surface and a rear wall surface thereof. A coupling means in the throughbore at the rear wall surface couples a flow line carrying heated water under pressure thereto. A spray nozzle mounted in the front wall surface of the support body extends into the throughbore. The spray nozzle has a tip with a discharge orifice located to the rear and above the top surface of the distributor body for producing a generally planar, fan-like spray pattern of heated water and directs the spray pattern downwardly at a slight angle to the top surface toward and against the deflecting edge. A plastic flow line T-fitting has a sealed off center leg that is mounted in the distributor body bottom surface. A plastic second spray nozzle is mounted in an arm of the T-fitting and extends forwardly of the distributor body front wall surface to direct a jet of cleaning chemical fluid in a forward direction. Means are provided that connect a flow line carrying cleaning chemical fluid under pressure to the other arm of the T-fitting. In operation, a spray of heated water from the nozzle striking the deflecting edge and deflected from the edge at a high velocity may be selectively alternated with a spray of cleaning chemical fluid from the second nozzle, toward a surface to be restored.

These and further and other objects and features of the invention are apparent in the disclosure, which includes the above and ongoing written specification, with the drawings.

DETAILED DESCRIPTION OF THE PREFERRED EMBODIMENTS

Figure 1:
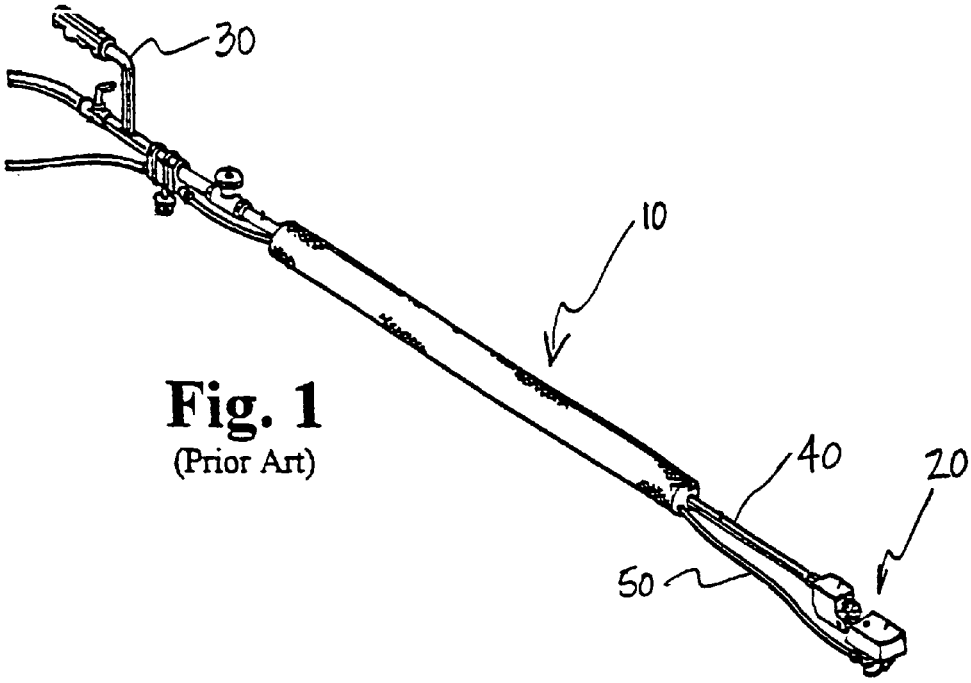
Fig. 1 (Prior Art)
FIG. 1 is an environmental perspective view of a prior art chemical spray cleaning wand assembly with spray head.

Referring now to the drawings, a high pressure chemical spray cleaning apparatus of the type disclosed in U.S. Pat. No. 4,046,321, titled HIGH PRESSURE SPRAY CLEANING HEAD, which is hereby incorporated by reference in its entirety, includes the wand assembly shown in FIG. 1. In general, the wand assembly 10 is comprised of separate flexible flow lines connected to wand assembly 10. The assembly is hand held by the operator to direct a spray toward an object to be cleaned, for example a brick wall having portland cement or the like (undesirable material) splattered thereon. The wand assembly 10 is shown to comprise a rigid water pipe 40 having a handle 30 mounted at the inlet end thereof and a spray head 20 mounted at the outlet end of pipe 40. A length of flexible plastic tubing 50 conveys chemical cleaning fluid from a chemical flow line to an inlet of the spray head 20.

Figure 2:
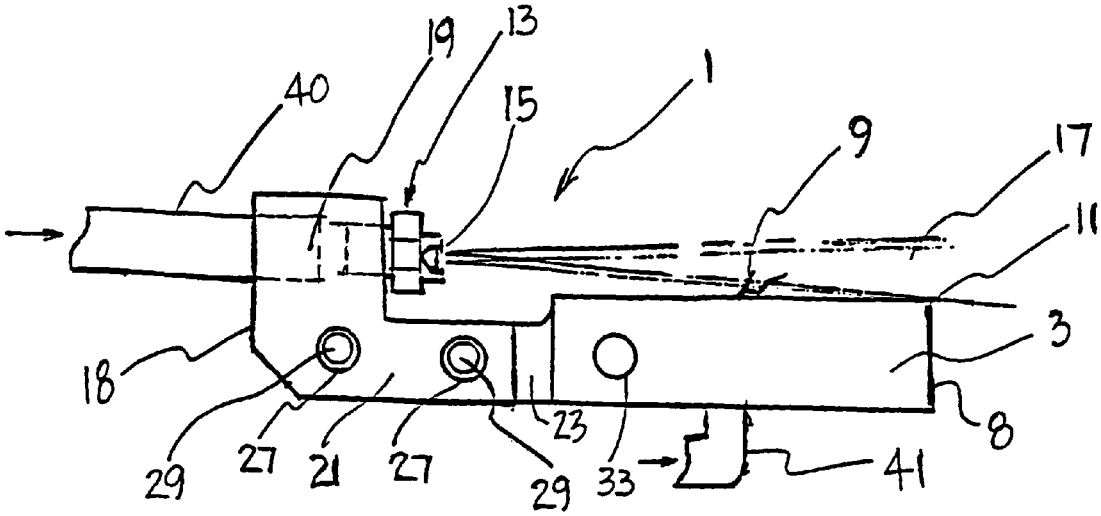
FIG. 2 is a side elevation view of an improved spray head.
Figure 3:
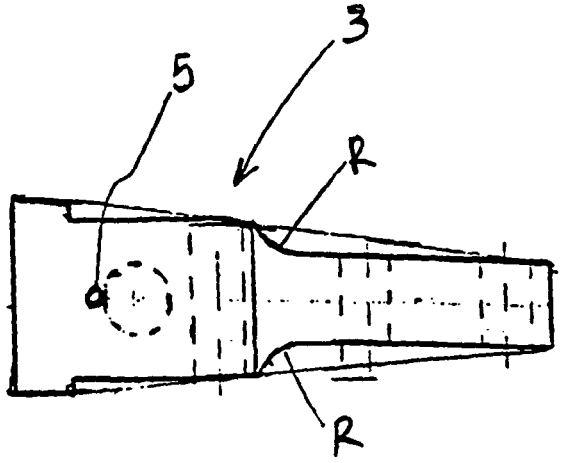
FIG. 3 is a top plan view of a distributor body for the improved spray head of FIG. 2.
Figure 4:
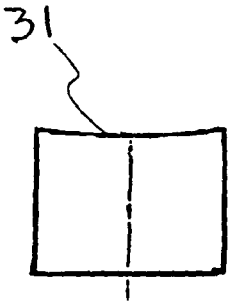
FIG. 4 is a front elevation view of the distributor body of FIG. 3.
Figure 5:
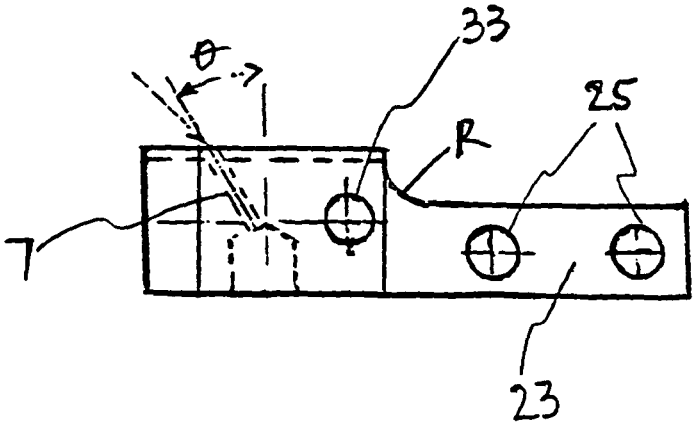
FIG. 5 is a side elevation view of the distributor body of FIG. 3.

FIG. 2 shows an improved spray head 1 for use with wand assembly 10. The spray head 1 functions to intimately mix the cleaning fluid and hot carrier water to emit the mixture as a fine, high velocity, highly concentrated spray 17 that displays itself in a generally fan-like pattern. The spray head 1 is comprised of a nozzle support body 18 that has a through bore 19, above and parallel with the forked end portion 21, that is internally threaded to support a spray nozzle 13 at the forward end and an internally threaded fitting to releasably connect the rigid water pipe 40 thereto at the inlet end.

As shown in FIGS. 2-5, the spray head 1 is further comprised of a distributor body 3 having a generally oblong, trapezoidal shape with a rearwardly extending lug portion 23. The distributor body 3 has a top surface 31 that terminates in a leading knife-like edge 11 formed by the top surface 31 and the front face 8 arranged normal thereto. The top surface 31 is slightly laterally dished or downwardly concave so that the leading edge 11 is slightly concavely curved. A chemical discharge aperture or opening 5 is centered in surface 31 between the sides. A small bore hole 7 in the body forms opening 5. Hole 7 is arranged at a forwardly directed angle θ, of approximately 30°, and emits a forwardly directed jet 9 of chemical cleaning fluid into the water spray prior to its striking edge 11. Bore hole 7 is enlarged at its inlet end and has internal threads that receive one end of a right angle fitting 41 that is coupled at its opposite end to the flexible tube flow line 50. In this way the cleaning fluid is conveyed upwardly through the distributor body to the discharge aperture 5. Lug portion 23 projects away from a rear wall surface of the distributor body 3, and has a pair of horizontal apertures 25 extending therethrough. The elongated lug portion 23 is connected to the distributor body through a transition region that includes radiused R sides and a top. These radii R serve to provide added strength to that area of the distributor body 3 and lug portion 23, in order to prevent cracking and breakage.

Nozzle support body 18 is securely attached to the distributor body 3 by the provision of a forked forwardly projecting portion 21 that projects from a forward wall surface of the support body 18. Forked projecting portion 21 slidably receives the lug portion 23 extending from the rear wall of the distributor body 3, together with bolts 29 that thread through the seats of two pair opposed aligned apertures 27 in the forked portion 21 and the pair of apertures 25 in the lug portion 23. The orifice 15 of the spray nozzle 13 is positioned above the plane of the deflecting surface. The spray nozzle 13 forms a fan-like spray pattern of about 15 degrees that intersects the corners of the leading edge 11 of the distributor body formed by parallel side surfaces and the front surface thereof. By using a spray pattern nozzle in which the spray is essentially planar and has a limited angle pattern and directing it off an edge 11, there is a more concentrated force provided by the mixture as it leaves distributor body 3. In this way the fine spray is concentrated at a series of points along a line provided by the leading edge 11. The forwardly angled bore hole 7 and forwardly directed jet 9 of chemical cleaning fluid operates to provide improved diffusion and better cleaning fluid/heated water mix. The distributor body 3 is made of a chemical resistant material such as zirconium, titanium or chlorinated polyvinyl chloride (CPVC).

Figure 6:
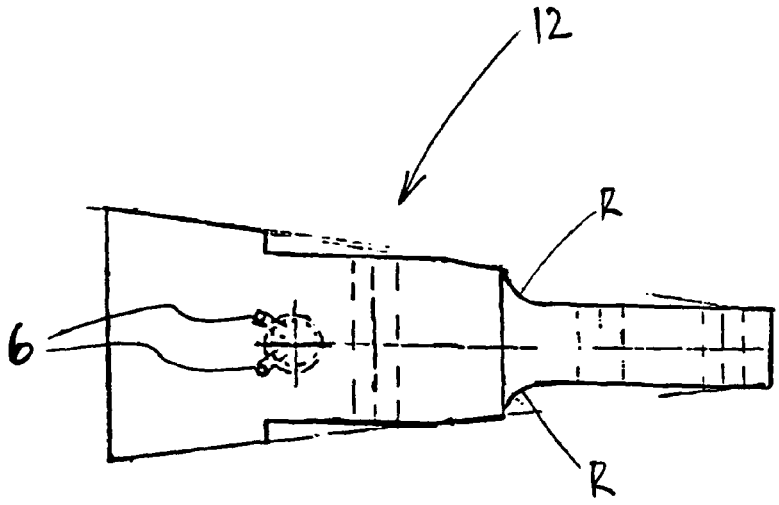
FIG. 6 is a top plan view of a large distributor body for the improved spray head.
Figure 7:
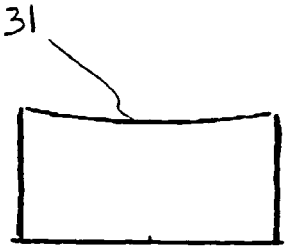
FIG. 7 is a front elevation view of the large distributor body of FIG. 6.
Figure 8:
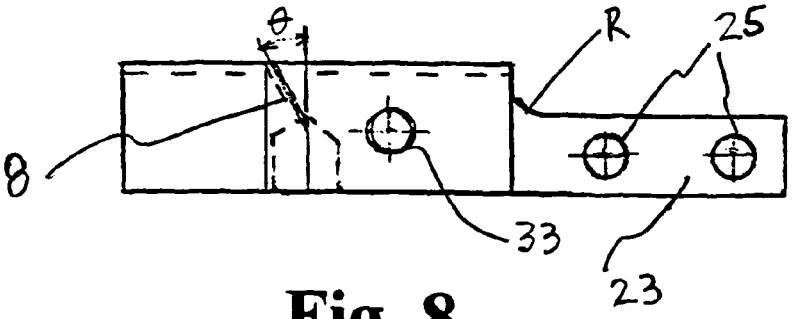
FIG. 8 is a side elevation view of the large distributor body of FIG. 6.

In FIGS. 6-8 is shown a larger form of the distributor body 12, having a generally larger, oblong, trapezoidal shape with a rearwardly extending lug portion 23. The distributor body 12 has a top surface 31 that is also slightly laterally dished or downwardly concave so that the leading edge 11 is slightly concavely curved. Two chemical discharge apertures or openings 6 are offset at either side of the centerline of surface 31. Two small bore holes 8 diverge upwardly from an enlarged inlet in the body and form openings 6. Holes 8 are arranged at a forwardly directed angle θ, of approximately 30°, and emit a pair of forwardly directed jets 9 of chemical cleaning fluid into the water spray prior to its striking edge 11. The enlarged inlet of bore holes 8 has internal threads that receive one end of a right angle fitting 41 that is coupled at its opposite end to the flexible tube 50. In this way the cleaning fluid is conveyed upwardly through the distributor body to the discharge apertures 6. As with the smaller distributor body, lug portion 23 projects away from a rear wall surface of the larger form of distributor body 12, and has a pair of horizontal apertures 25 extending therethrough. The elongated lug portion 23 is connected to the distributor body through a transition region that includes a radiused R top and sides. These radii R serve to provide added strength to that area of the distributor body 12 and lug portion 23, in order to prevent cracking and breakage. As with the smaller distributor body 3, forwardly angled bore holes 8 and forwardly directed jets 9 of chemical cleaning fluid in the larger distributor body 12 operate to provide improved diffusion and improved cleaning fluid/heated water mix. The distributor body 12 is also made of a chemical resistant material such as zirconium, titanium or chlorinated polyvinyl chloride (CPVC).

Distributor bodies 3 and 12 each have a generally trapezoidal, horizontal cross-sectional shape. By forming the distributor body in this fashion it further helps to improve the fluid flow, spray diffusion and chemical cleaning fluid/water mix. In addition, the trapezoidal shape allows for a better material yield, when manufacturing the improved distributor body, over previous generally rectangular spray head distributor bodies.

Figure 9:
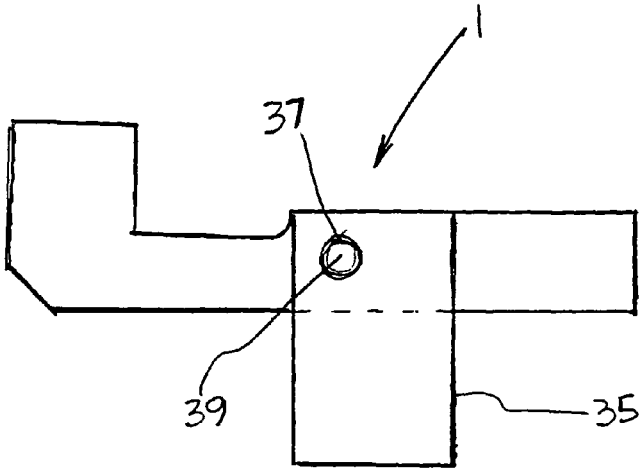
FIG. 9 is a side elevation view of an improved spray head with an elbow guard in place.
Figure 10:
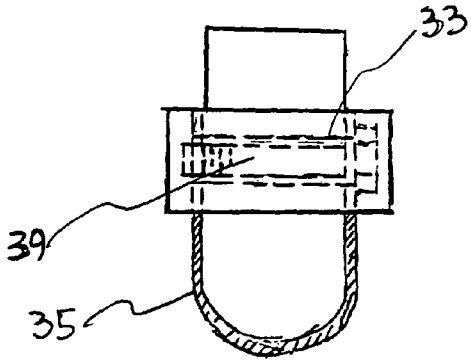
FIG. 10 is a front elevation view of the spray head and elbow guard of FIG. 9.

A rigid, U-shaped elbow guard member 35, shown in FIGS. 9 and 10, is fastened by an elongated fastening member 39 comprising a bolt or screw extending through aligned holes 37 in the arms of the guard member 35. Fastening member 39 passes through a third horizontal aperture 33 in the distributor body at about the mid-point thereof. The U-shaped guard member 35 is preferably made from a piece of bent stainless steel and extends under and around the fitting 41 to protect it against breakage.

Figure 11:
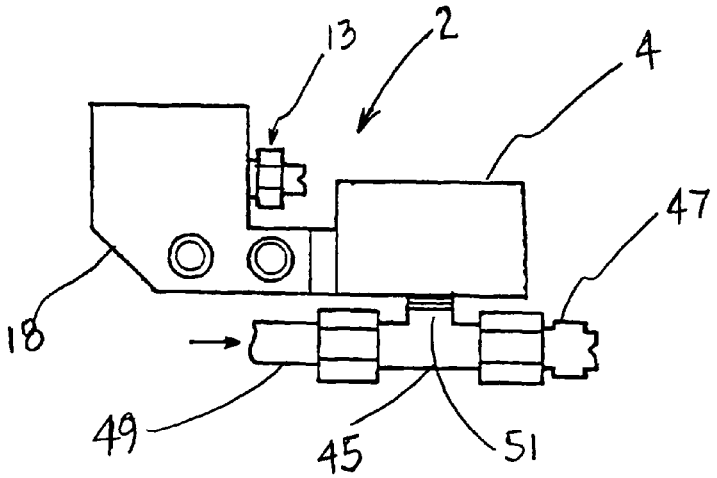
FIG. 11 is a side elevation view of an alternative embodiment of an improved spray head for restoration cleaning applications.

In FIG. 11 is shown an improved spray head 2, which is particularly well suited for restoration cleaning. Support body 18, spray nozzle 13 and distributor body 4 are generally the same as described above. Distributor body 4 is preferably made of chlorinated polyvinyl chloride (CPVC). Secured in the enlarged inlet end of the upwardly angled bore is the center leg 51 of a plastic flow line T-fitting 45. The center leg 51 is sealed off to prevent chemical cleaning fluid from entering the upwardly angled bore in the distributor body 4. A second spray nozzle 47, made of plastic, is mounted in an arm of the T-fitting 45 and extends forwardly of the distributor body 4 front wall surface to direct a jet of cleaning chemical fluid in a forward direction. Means are provided for connecting flow line 50 carrying cleaning chemical fluid under pressure to the other arm 49 of the T-fitting. In normal restoration cleaning, chemical cleaning fluid is applied through the plastic spray nozzle 47. After covering an area with cleaning fluid, the operator rinses the area with the pressurized water sprayed from nozzle 13. The operator is able to selectively alternate the spraying of cleaning chemical fluid from second nozzle 47, with the spraying of heated water from nozzle 13, and thereby saves time by not having to switch between two separate wands and spraying apparatuses.

While the invention has been described with reference to specific embodiments, modifications and variations of the invention may be constructed without departing from the scope of the invention.

The invention claimed is:

1. A spray head operated by a fluid under pressure for spray cleaning a surface comprising:

a distributor body of a cleaning chemical corrosion-resistant material having a top surface and a front surface substantially normal to said top surface, said front surface and top surface meeting at a deflecting edge, said distributor body having a trapezoidal configuration in horizontal cross-section, said distributor body having at least one discharge aperture in said top surface leading from at least one bore in said body through which a jet of a cleaning chemical fluid is delivered under pressure, said at least one bore being arranged within the body at a forwardly directed angle to direct a jet of cleaning chemical fluid away from said top surface and toward said deflecting edge; and a spray nozzle support body adjacent the distributor body having an inlet adapted to receive a supply of heated carrier fluid under pressure, said spray nozzle support body having a spray nozzle located at the rear of and above the top surface of said distributor body and said discharge aperture for producing a substantially horizontal, generally planar, fan-like pattern of heated carrier fluid and directing said spray pattern at a slight angle to said top surface toward and against said deflecting edge whereby the jet of chemical cleaning fluid is emitted into the spray of heated carrier fluid prior to striking said deflecting edge and whereby the cleaning chemical fluid and heated carrier fluid are intimately mixed and the mixture is deflected from said edge as a mixed spray in a concentrated form that is directed toward a surface to be cleaned.

2. The spray head according to claim 1, wherein said spray nozzle support body includes a throughbore having one end forming an inlet and said spray nozzle with an orifice mounted on the outlet end of the throughbore, said support body having a projecting portion connected to a projecting portion on the distributor body, said projecting portion on the distributor body comprising an elongated lug portion.

3. The spray head according to claim 2, wherein said elongated lug portion includes a pair of horizontal apertures, said support body projecting portion being a forked member that slidably receives said elongated lug portion and has two sets of opposed apertures aligned with the pair of apertures in said lug portion, and a pair of securing members extending through said aligned apertures and securing said distributor body to said support body.

4. The spray head according to claim 1, wherein said top surface of said distributor body is slightly inwardly concave in shape.

5. The spray head according to claim 1, wherein said distributor body is made of a corrosion resistant material selected from the group consisting of zirconium, chlorinated polyvinyl chloride, and titanium.

6. The spray head according to claim 1, wherein said at least one discharge aperture is a pair of discharge apertures and said at least one bore is a pair of bores that upwardly diverge and are arranged at a forwardly directed angle to direct a pair of jets of cleaning chemical fluid away from said top surface and toward said deflecting edge.

7. The spray head according to claim 2, wherein said elongated lug portion is connected to said distributor body through a transition region having a radiused top and sides.

8. The spray head according to claim 3, further including a third horizontal aperture extending through said distributor body, a U-shaped elbow guard having a pair of arms connected by a bight portion with a pair holes in the arms of the U-shaped elbow guard aligned with the third horizontal aperture, and an elongated fastening member extending through said aligned apertures securing said U-shaped elbow guard to said distributor body.

9. The spray head according to claim 8, wherein said U-shaped elbow guard is made of stainless steel.

10. A distributor body for a spray head operated by a fluid under pressure for spray cleaning a surface, said distributor body comprising:

a top surface and a front surface normal to said top surface, said front surface and top surface meeting at a deflecting edge, said distributor body having a trapezoidal configuration in horizontal cross-section, said distributor body further having at least one discharge aperture in said top surface leading from at least one bore in said body through which a jet of a cleaning chemical fluid is delivered under pressure, said at least one bore being arranged within the body at a forwardly directed angle to direct a jet of cleaning chemical fluid away from said top surface and toward said deflecting edge; and wherein said distributor body is formed of a cleaning chemical corrosion-resistant material.

11. The distributor body for a spray head according to claim 10, further including a projecting portion on the distributor body, wherein said projecting portion on the distributor body comprises an elongated lug portion having a pair of horizontal apertures for receiving a pair of securing members therethrough.

12. The distributor body for a spray head according to claim 10, wherein said top surface of said distributor body is slightly inwardly concave in shape.

13. The distributor body for a spray head according to claim 10, wherein said distributor body is made of a corrosion resistant material selected from the group consisting of zirconium, chlorinated polyvinyl chloride, and titanium.

14. The distributor body for a spray head according to claim 10, wherein said at least one discharge aperture is a pair of discharge apertures and said at least one bore is a pair of bores that upwardly diverge and are arranged at a forwardly directed angle to direct a pair of jets of cleaning chemical fluid away from said top surface and toward said deflecting edge.

15. The distributor body for a spray head according to claim 11, wherein said elongated lug portion is connected to said distributor body through a transition region having a radiused top and sides.

16. The distributor body for a spray head according to claim 11, further including a third horizontal aperture extending through said distributor body, a U-shaped elbow guard having a pair of arms connected by a bight portion with a pair holes in the arms of the U-shaped elbow guard aligned with the third horizontal aperture, and an elongated fastening member extending through said aligned apertures securing said U-shaped elbow guard to said distributor body.

17. The distributor body for a spray head according to claim 16, wherein said U-shaped elbow guard is made of stainless steel.

18. A spray head operated by separate supplies of heated water under pressure and a cleaning chemical fluid under pressure for restoration cleaning of a surface by spraying comprising:

a distributor body of trapezoidal, oblong shape made of a corrosion resistant material having a top surface, a bottom surface, opposed side wall surfaces and a front wall surface, said top and front wall surfaces meeting at a leading deflecting edge, said top surface being slightly inwardly concave and having at least one discharge aperture therein leading from at least one bore in said distributor body arranged within the body at a forwardly directed angle, said distributor body having a lug portion projecting away from a rear wall surface thereof with a pair of apertures;

a support body having a forked projecting portion extending forwardly of a front wall surface that slidably receives said lug portion and has two sets of opposed apertures aligned with the apertures in said lug portion and a pair of securing members extending through said aligned apertures securing said distributor body to said support body, the rear wall surface of the distributor body and the front wall surface of the support body being oppositely disposed from one another, said support body having a throughbore passing through the front wall surface and a rear wall surface thereof with coupling means in the rear wall surface to couple a flow line carrying heated water under pressure thereto;

a spray nozzle mounted in the front wall surface of the support body and extending into the throughbore having a tip with a discharge orifice located to the rear and above the top surface of said distributor body for producing a generally planar, fan-like spray pattern of heated water and directing said spray pattern downwardly at a slight angle to said top surface toward and against said deflecting edge, said spray pattern being in a fan-like pattern, and a flow line T-fitting having a center leg thereof being sealed off and mounted in said distributor body bottom surface, a second spray nozzle mounted in an arm of the T-fitting and extending forwardly of the distributor body front wall surface to direct a jet of cleaning chemical fluid in a forward direction, and means for connecting a flow line carrying cleaning chemical fluid under pressure to the other arm of said T-fitting;

whereby a spray of heated water from said nozzle striking said deflecting edge and deflected from said edge at a high velocity may be selectively alternated with a spray of cleaning chemical fluid from said second nozzle, toward a surface to be restored.

19. The spray head according to claim 18, wherein the distributor body is made of chlorinated polyvinyl chloride.

20. The spray head according to claim 18, wherein the T-fitting and second spray nozzle are made of plastic.

* * * * *